United States Patent [19]

Kanamaru et al.

[11] 4,452,060

[45] Jun. 5, 1984

[54] METHOD OF PROCESSING CYLINDRICAL SURFACE

[75] Inventors: Hisanobu Kanamaru, Katsuta; Masaharu Oku, Mito, both of Japan

[73] Assignee: Hitachi, Ltd., Tokyo, Japan

[21] Appl. No.: 368,663

[22] Filed: Apr. 15, 1982

[30] Foreign Application Priority Data

Apr. 22, 1981 [JP] Japan ..... 56-59824

[51] Int. Cl.[3] ..... B21K 21/00

[52] U.S. Cl. ..... 72/117; 72/358; 72/370

[58] Field of Search ..... 72/68, 115, 117, 125, 72/358, 370, 378, 348

[56] References Cited

U.S. PATENT DOCUMENTS

| | | | |
|---|---|---|---|
| 1,225,915 | 5/1917 | Zerk | 72/348 |
| 1,985,833 | 12/1934 | Lampart | 72/358 |

FOREIGN PATENT DOCUMENTS

| | | | |
|---|---|---|---|
| 622352 | 11/1935 | Fed. Rep. of Germany | 72/117 |
| 1062091 | 7/1959 | Fed. Rep. of Germany | 72/358 |
| 365881 | 4/1939 | Italy | 72/370 |

*Primary Examiner*—Lowell A. Larson

*Attorney, Agent, or Firm*—Antonelli, Terry & Wands

[57] ABSTRACT

A method of mechanically processing the cylindrical surface of a part having a cylindrical portion. The cylindrical portion is beforehand provided with a supporting portion at its one end, for producing and imparting a tension to the surface to be processed. An axial relative movement is caused between a punch fitted in the cylindrical portion and a die fitted around the same, so that a plastic deformation is caused on the cylindrical surface to form grooves or teeth in the cylindrical surface, while applying a tension to the material of the cylindrical portion presenting the cylindrical surface.

7 Claims, 8 Drawing Figures

METHOD OF PROCESSING CYLINDRICAL SURFACE

BACKGROUND OF THE INVENTION

The present invention relates to a method of processing a cylindrical surface and, more particularly, to a method for mechanically processing an inner or outer cylindrical surface of a cylindrical part in which a punch in the cylindrical part and a die fitted to the outside of the cylindrical part are moved relatively to each other in an axial direction of the cylindrical part to impart a tension to the processed surface to effect a plastic deformation, to thereby form grooves or teeth in the processed surface.

Hitherto, cutting work has been adopted as a major processing method for producing cylindrical parts having grooves or teeth in the inner or outer peripheral surface thereof such as parts having a helical involute spline in the cylindrical surface, e.g. the outer part of one-way clutch of automotive starter, parts for automotive transmission and so forth. The cutting work, however, suffers various disadvantage such as uneconomically high cost of the tool, short life of the tool requiring frequent grinding and impractically long processing time attributable to the inferior working efficiency. Consequently, the processing of cylindrical surface by cutting work raises the overall cost of the products. This is quite disadvantageous from the view point of mass-production of parts, particularly automotive parts.

In recent years, approaches have been made to the utilization of plastic work for forming grooves, teeth or the like in the cylindrical surface but such a technique encounters various difficulties when applied to the formation of helical gear teeth or helical involute spline.

Namely, in the known method of processing of cylindrical surface of a cylindrical member by a plastic deformation, the plastic deformation of the blank material is made solely by the compression applied to the blank, so that the blank can hardly be deformed to require a large force for driving the punch. In addition, since the blank material is pressed by a force greater than the resistance to the compression, a seizure is liable to occur between the punch and the blank or between the die and the blank. In addition, the grooves or teeth cannot be formed at sufficiently high precision. In other words, this known method relying upon compression deformation is to forcibly deform the blank while keeping the latter under a condition resisting to the deformation. Consquently, this method could process, when applied to the production of a part having a helical involute spline in its inner peripheral surface, only a small helical angle of about 18° or less. Namely, helical angle in excess of 18° could not be processed by this known method because of a seizure of the punch.

SUMMARY OF THE INVENTION

Accordingly, an object of the invention is to provide a method of processing a cylindrical surface in which a tension is applied to the blank material during the formation to permit a plastic work with a force smaller than the deformation resistance of the material, to make it possible to form grooves or teeth at high dimensional precision with a comparatively small force of driving of the punch without seizure, thereby to overcome the above-described problems of the prior art.

Another object of the invention is to provide a method of processing a cylindrical surface suitable for processing the inner or outer cylindrical surface of a blank material and capable of forming grooves or teeth in the inner or outer cylindrical surface of the blank material at a high dimensional precision by plastic deformation with a comparatively small driving force of the punch while eliminating the undesirable seizure of the punch or die.

To this end, according to the invention, there is provided a method of processing a cylindrical surface in which a supporting portion is previously formed on one end of a cylindrical blank and grooves or teeth are formed in the cylindrical surface of the blank by a plastic work while applying, through the supporting portion, a tensile stress to the blank by causing a relative axial movement between a punch placed at the inside of the blank and a die placed at the outside of the blank.

These and other objects, features and advantages of the invention will become clear from the following description of the preferred embodiments taken in conjunction with the accompanying drawings.

DESCRIPTION OF THE PREFERRED EMBODIMENT

Figure 1:
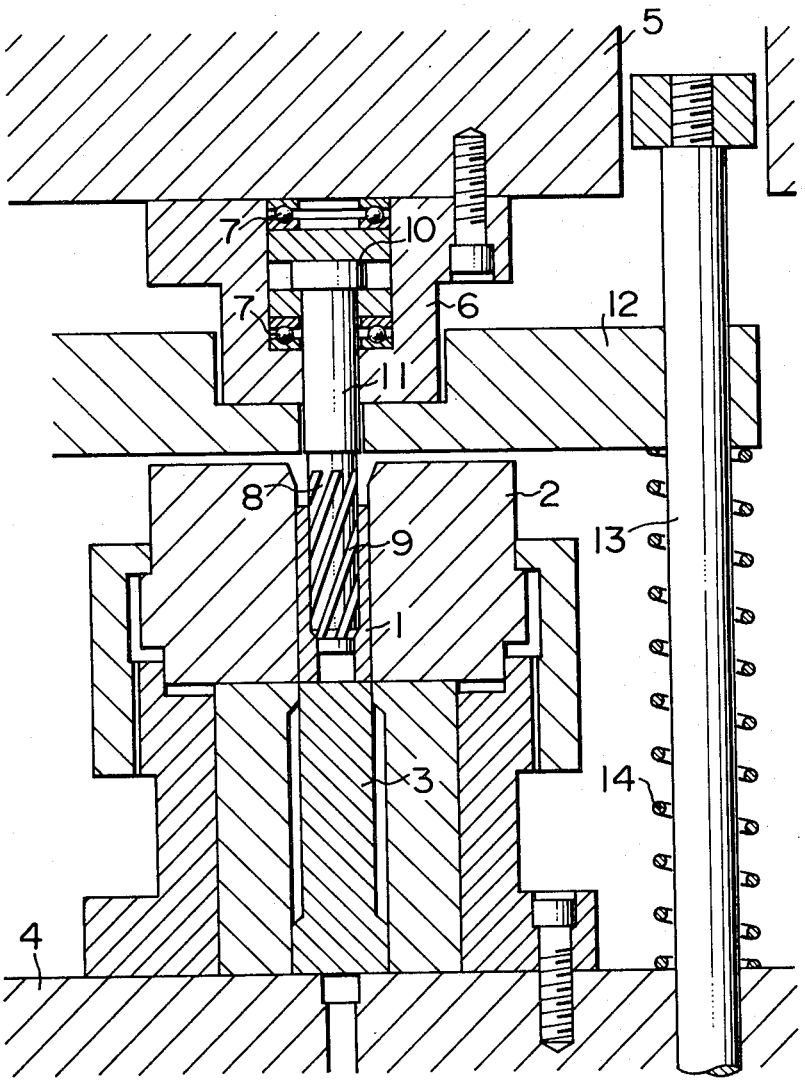
PRIOR ART FIG. 1
FIG. 1 is a vertical sectional view of an example of a die apparatus for carrying out a known method of processing the inner cylindrical surface of a cylindrical part.

Referring now to the drawings wherein like reference numerals are used throughout the various views to designate like parts and, more particularly, to FIG. 1, according to this figure, a cylindrical blank 1 is supported at its outer peripheral surface by an outer die 2, while the lower end of the cylindrical blank 1 is supported by a knock-out 3 for pushing out the product. The outer die 2 and the knock-out 3 are stationarily fixed to a stationary base 4.

A holder 6, fixed to a movable base 5 above the stationary base 4, rotatably carries a punch 8 through thrust bearings 7. A helical involute spline 9 is formed in the outer peripheral surface of the punch 8. In the illustrated embodiment, the punch 8 is supported at its head 10 clamped by the thrust bearings 7. The punch 8 has a guiding portion 11 which is extended through the opening of the guide 12. The guide 12 is adapted to move up and down along a guide rod 13 standing upright from the stationary base 4. A reference numeral 14 designates a spring for resetting the guide 12.

In processing the inner cylindrical surface of a cylindrical part, the movable base 5 is moved downward to press the punch 8 onto the inner cylindrical surface of the blank 1. Simultaneously with the driving, the punch 8 is moved downwardly while rotating along the helical angle of the helical involute spline 9. Consequently, a helical involute spline corresponding to the helical involute spline 9 is formed by a plastic deformation in the inner cylindrical surface of the blank 1. As stated before, however, only compression is applied to the blank 1 during the plastic deformation of the inner cylindrical surface by the conventional processing method shown in FIG. 1. Consequently, the blank 1 can hardly be deformed and a large force is required for driving the punch 8. In addition, since the punch 8 is driven overcoming this large resistance against compression, seizure is liable to occur between the punch 8 and the blank 1 even when the blank 1 is suitably lubricated. Furthermore, the grooves or the teeth are formed only at a low dimensional precision according to this method.

These problems of the prior art, however, can effectively be overcome by the method of the invention as will be understood from the following description of the preferred embodiments taken in conjunction with FIGS. 2 through 7.

Figure 2:
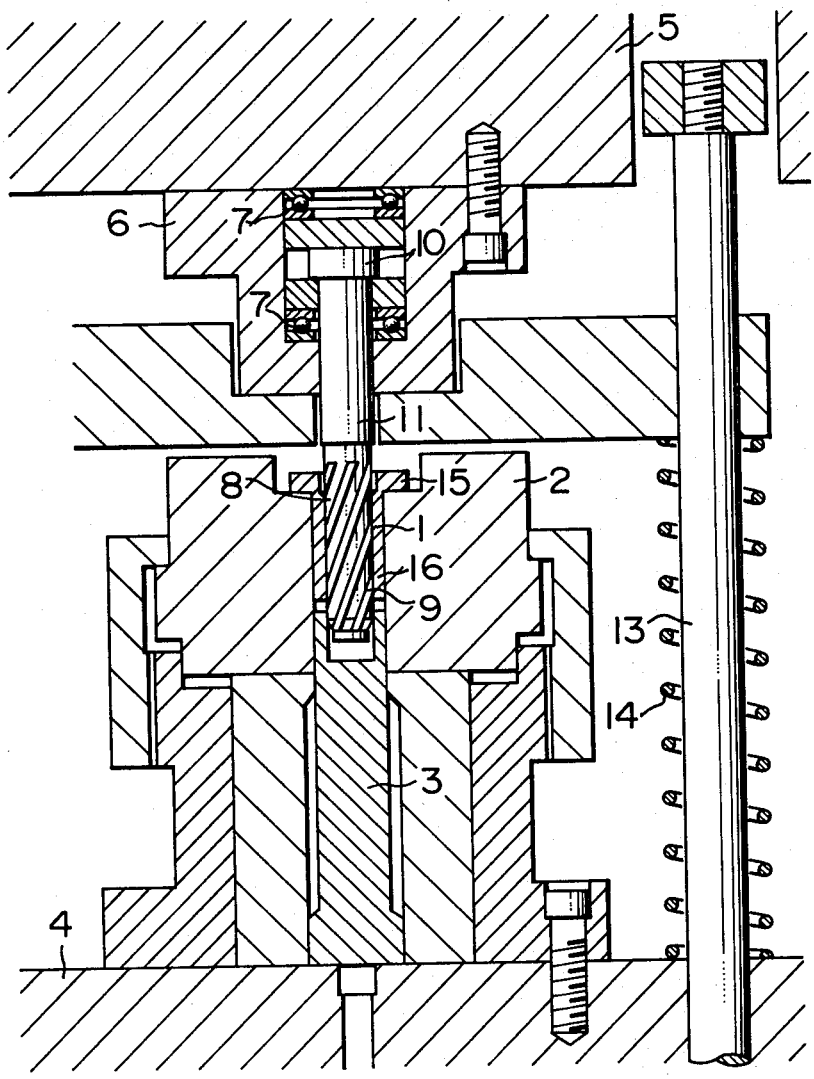
FIG. 2 is a vertical sectional view of an example of a die apparatus for processing the inner cylindrical surface of a cylindrical part in accordance with a method of the invention for processing a cylindrical surface.

More specifically, the die apparatus shown in FIG. 2 has a punch 8 having a helical involute spline into the inner cylindrical surface of a cylindrical blank 1 to thereby form a helical involute spline in the inner cylindrical surface.

Referring to FIG. 2, the blank 1 made of a material such as carbon steel, alloy steel or the like is provided at its one end (upper end in this case) with a flange 15 having a thickness large enough to withstand a shearing force which is applied thereto during the processing. The blank 1 is supported at the stepped surface of the flange 15 and at the outer peripheral surface of the cylindrical part 16 thereof by means of a die 2. The die 2 is fixed to a stationary base 4 in the same manner as the prior art explained before in connection with FIG. 1. Also, the punch 8 is rotatably supported by the movable base 5 through the medium of thrust bearings 7 as in the case of the prior art explained before in connection with FIG. 1.

Figure 3:
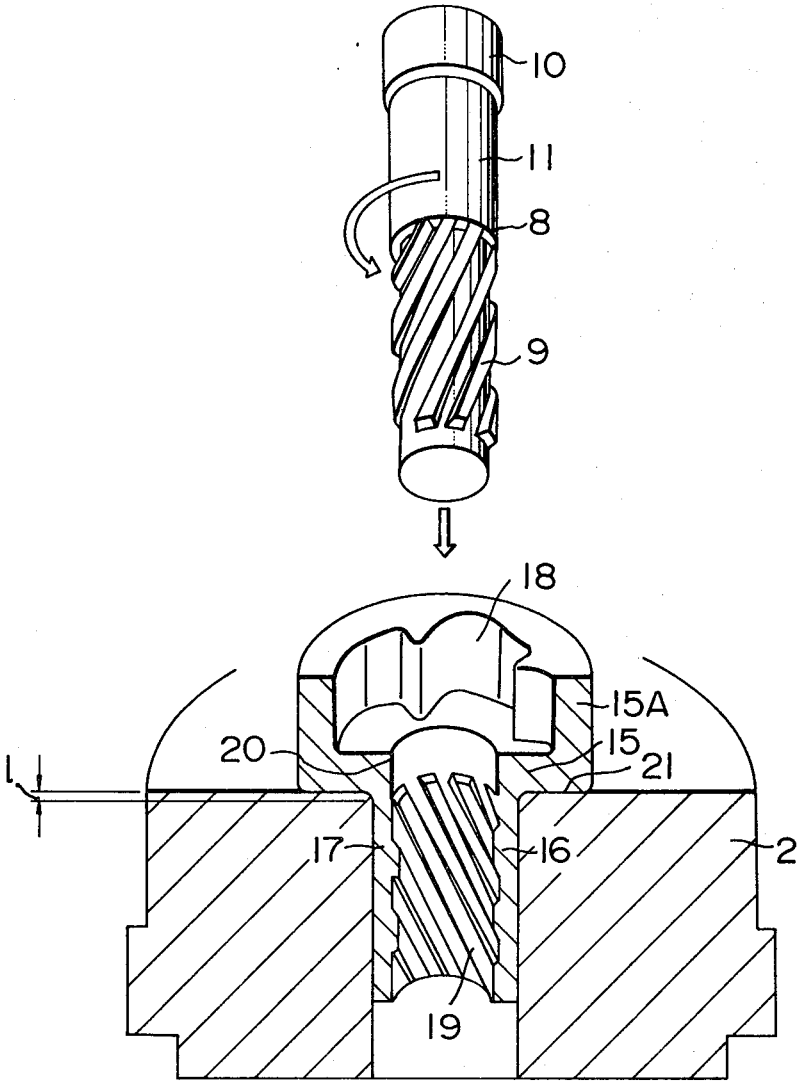
FIG. 3 is an enlarged perspective view of a cylindrical surface processing method of the invention applied to the production of the outer part of one-way clutch of an automotive starter.

As shown in FIG. 3, an outer part 17 of the one-way clutch of the automotive starter as a cylindrical part is provided in the portion of the inner cylindrical surface thereof below the flange stepped surface 21 with a helical involute spline formed by a plastic deformation. Also, a cam shape 18 of outer part of the one-way clutch is formed in the inner side of the axial extension 15A of the flange 15.

The blank before the formation of the helical involute spline is supported at its stepped surface 21 of the flange 15 and the outer peripheral surface of the cylindrical portion 16 by means of the die 2. A stepped inner cylindrical portion 20 of a diameter substantially equal to the outside diameter of the punch 8 or slightly greater than the same is beforehand formed in the inner peripheral surface of the blank 1 at a portion adjacent to the flange 15. The stepped inner cylindrical portion 20 preferably extends to the substantially same axial depth as the stepped surface 21 of the flange 15 or greater. In the embodiment shown in FIG. 3, the inner cylindrical portion 20 extends to an axial depth greater by a length l than the stepped surface 21 of the flange 15. In operation, the punch 8 having a helical involute spline 9 is pressed into the bore of the cylindrical portion 16 through the end adjacent to the flange 15. Since the punch 8 is rotatable, the punch 8 is driven while being rotated along its helical angle while effecting a plastic work to form a helical involute spline 19 in the portion of the inner cylindrical surface of the cylindrical portion 16 below the stepped surface 21 of the flange. In FIG. 3, a reference numeral 11 designates a guide portion of the punch 8, while 10 designates the head portion of the punch 8.

According to the processing method illustrated in FIG. 3, it is possible to completely eliminate the compression stress generated during driving of the punch 8 into the cylindrical portion 16, i.e. the compression stress caused in the material of the flange 15. In addition, the formation of the helical involute spline 19 by plastic deformation in the inner cylindrical surface of the cylindrical portion 16 can be made under such a state that only a tensile stress acts in the material of the cylindrical portion 16.

An explanation will be made hereinunder as to the condition for yielding of the material for effecting the necessary plastic deformation to the material of the cylindrical portion 16 of the blank 1. The principal stresses in three axial directions are represented by $\sigma_1$, $\sigma_2$ and $\sigma_3$, while the resistance to deformation of the material is represented by kf. It is assumed that there is a condition represented by $\sigma_1 > \sigma_2 > \sigma_3$. According to the Tresca's yielding condition, there is a relation expressed by $\sigma_1 - \sigma_3 \geqq kf$, i.e. $\sigma_1 \geqq kf + \sigma_3$. Thus, the maximum principal stress $\sigma_1$ necessary for imparting a plastic deformation to the material is determined by the deformation resistance kf of the material and the minimum principal stress $\sigma_3$. According to the processing method of the invention, since the material is tensed during the processing, the stress $\sigma_3$ acts as a stress opposite to the stress $\sigma_1$ which is a compression stress, i.e. as a tensile stress. Thus, the maximum principal stress necessary for the plastic deformation is expressed by $\sigma_1 \geqq kf - \sigma_3$.

In the processing method of the invention in which the plastic deformation is effected while applying a tensile stress $-\sigma_3$, it is possible to cause the plastic deformation with a force which is smaller than the deformation resistance kf of the material, in contrast to the conventional processing method in which the plastic work is conducted while applying a compression stress $+\sigma_3$ to the material.

Consequently, the force required for driving the punch 8 is decreased to facilitate the driving of the punch 8, so that the aforementioned problems encountered in the processing of a cylindrical surface by the prior art method are completely eliminated. Namely, in the embodiment shown in FIG. 3 for forming the helical involute spline in the inner cylindrical surface of the cylindrical portion 16, the seizure of the punch 8 is avoided and the dimensional precision of formation of the helical involute spline 19 is remarkably improved.

Figure 4A:
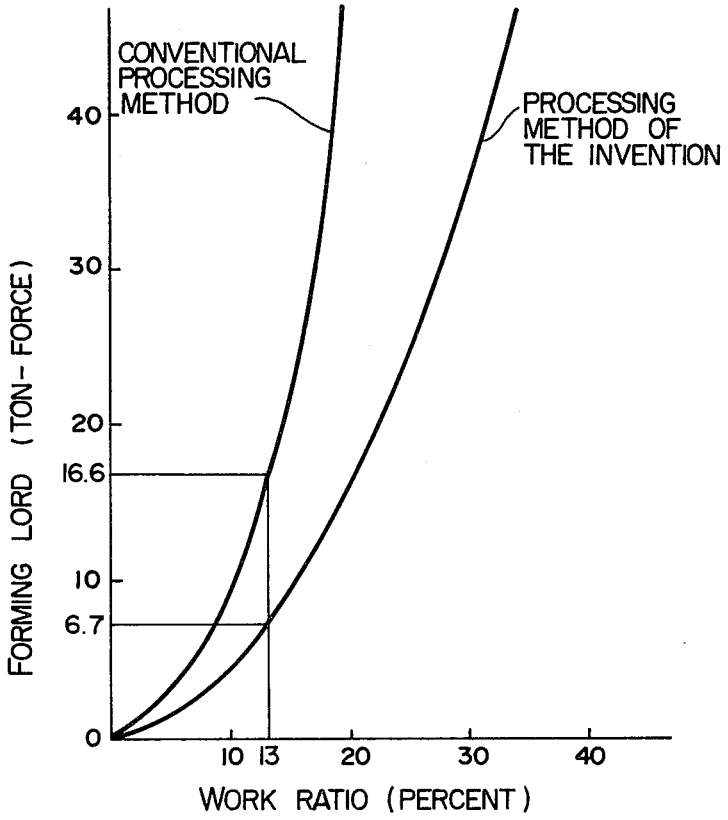
FIGS. 4A and 4B are graphs showing the punch driving force and the limit helical angle (processing limit) of involute when a helical involute spline is formed in the inner cylindrical surface of a cylindrical blank by the method of the invention and by the conventional method.

FIG. 4A shows, by way of example, the driving force for driving the punch, i.e. the forming load, when the inner cylindrical surface of a cylindrical part is processed by the processing method of the invention, in comparison with that in the conventional processing method. Using the blanks of same size and material, and assuming that the desired helical involute spline is formed at a word ratio of 13% in both cases, the processing method of the invention requires only a small forming load of 6.7 tf while the conventional processing method requires a large forming load of 16.6 tf. Thus, about 60% reduction of forming load is achieved by the present invention.

Figure 4B:
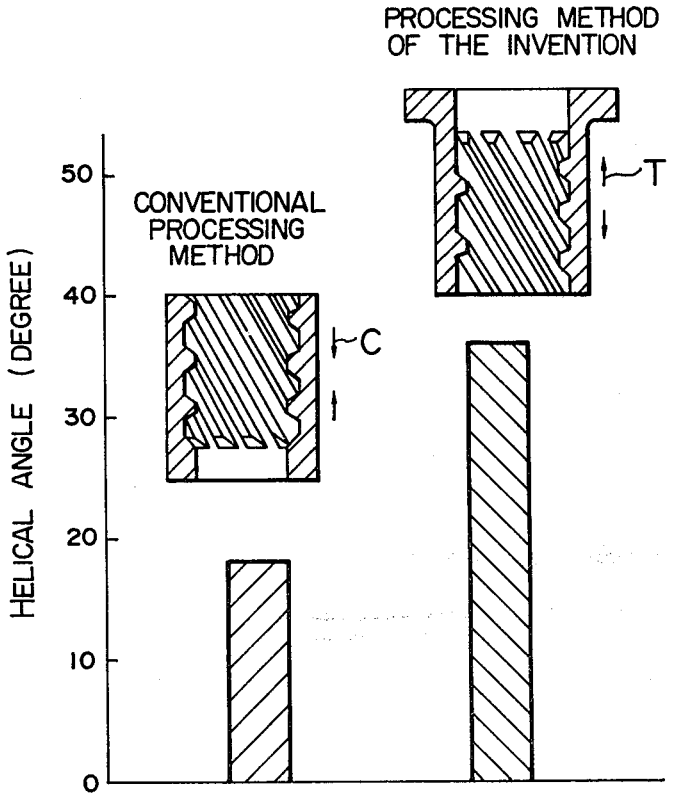

In the conventional processing method in which the plastic work is conducted while applying a compression as shown in FIG. 1, the practical limit of helical angle is about 18°. The processing method of the invention shown in FIG. 3 can remarkably increase the maximum helical angle which can be processed by plastic deformation, as will be seen from FIG. 4B which shows the practical processable limit of helical angle when the helical involute spline is formed at a working ratio of 13% by the processing method of the invention, in comparison with that in the known processing method. FIG. 4B shows that, while the practically processable limit of helical angle is as small as 18° in the prior art method in which the plastic work is effected while applying a compression C to the cylindrical part, the practically processable helical angle is remarkably increased up to about 36° by the embodiment of the processing method explained in connection with FIGS. 2 and 3 in which the plastic work is effected while applying a tension T to the cylindrical part.

With the prior art processing method in which the practically processable limit of helical angle is as small as about 18°, it is almost impossible to design the one-way clutch outer part having the desired performance. It is quite advantageous that the processing method of the invention widens the selection or freedom of design of one-way clutch outer part for obtaining desired performance and affords a mass-production of the same, thanks to the increased practically processable limit of the helical angle.

Figure 5:
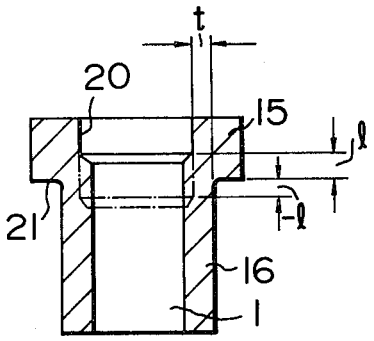
FIG. 5 is an illustration of the relationship between the depth of the stepped portion formed beforehand on the inner cylindrical surface adjacent to the flange of a cylindrical part and the position of the flange.
Figure 6:
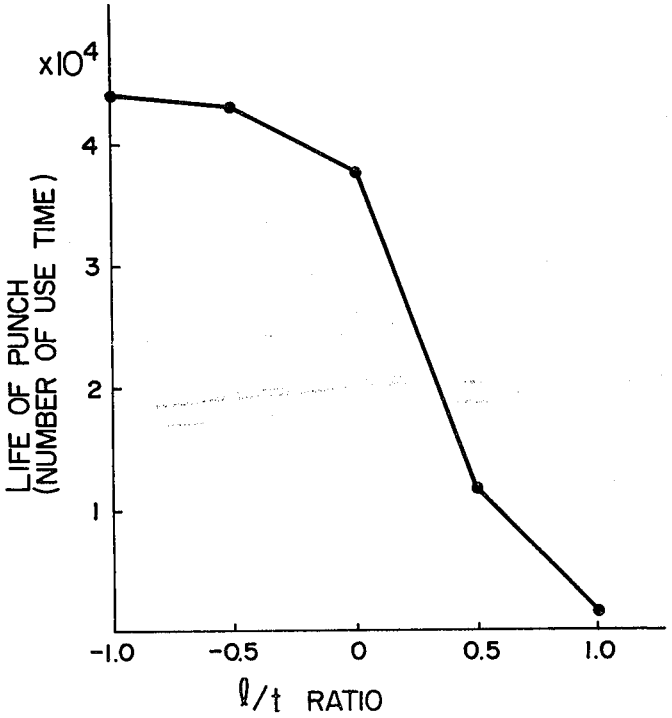
FIG. 6. is a graph illustrating the life characteristics of the die in relation to the depth (l) of the stepped portion shown in FIG. 5 and the wall-thickness (t) of the cylindrical part.

FIGS. 5 and 6 show how the life of the punch is related to the ratio between the axial depth of the stepped inner cylindrical portion 20 and the wall thickness of the wall presenting the stepped inner cylindrical portion 20 in the embodiment shown in FIG. 3. In these figures, the axial length l being zero means that the stepped inner cylindrical portion 20 extends to the same axial depth as the stepped surface 21 of the flange 15. The symbol − (minus) attached to the length l means that the axial depth of the stepped inner cylindrical portion 20 is greater than that of the surface 21 of the flange 15. To the contrary, the symbol + (plus) attached to the length l means that the axial depth of the stepped inner cylindrical portion 20 is smaller than that of the surface 21 of the flange 15.

As will be clearly seen from FIG. 6, it is possible to create a wholy tensile stress condition in the material during the plastic work to sufficiently decrease the force required for driving the punch 8 while remarkably improving the life of the same, by making the axial depth of the stepped inner cylindrical portion 20 greater than that of the stepped surface 21 of the flange 15. In addition, by so doing, it is possible to completely eliminate the undesirable seizure of the punch and to remarkably improve the dimensional precision of the cross-sectional shape of the groove or tooth of the helical involute spline or helical gear.

Figure 7:
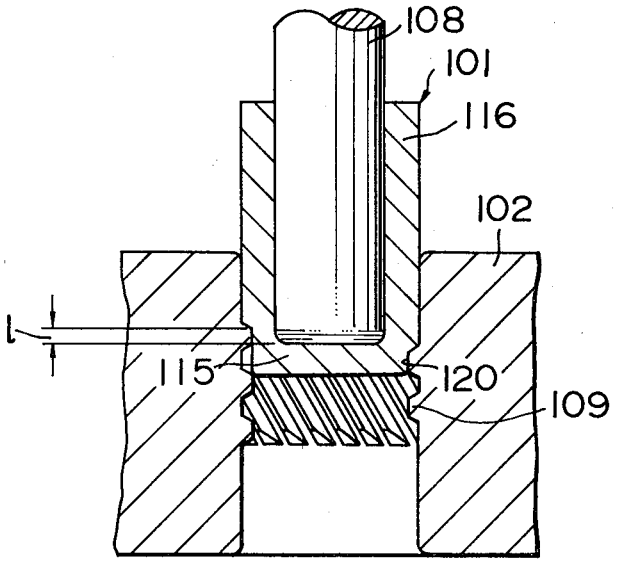
FIG. 7 is an enlarged partial sectional view of a portion of an embodiment of the invention for processing the outer cylindrical surface of the cylindrical part.

In FIG. 7, a cylindrical blank 101 is provided at its one end (lower end in this case) with a bottom portion having a thickness large enough to withstand a shearing force which is applied thereto during the processing. The blank 101 is supported at the outer peripheral surface of the cylindrical portion thereof by a die 102. A stepped outer cylindrical portion 120 of a diameter substantially equal to or smaller than the inside diameter of the helical involute spline 109 formed in the inner peripheral surface of the die 102 is beforehand provided in the outer cylindrical surface of the cylindrical portion 116 adjacent to the bottom thereof. Preferably, the stepped outer cylindrical portion 120 has an axial depth substantially equal to or smaller than that of the inner bottom surface of the bottom 115. In the embodiment shown in FIG. 7, the stepped outer cylindrical portion 120 has an axial depth smaller than that of the inner bottom surface by a length l.

The die apparatus itself is not shown because it is materially identical to that shown in FIG. 2 for processing the inner cylindrical surface, except that the processing part, i.e. the involute helical spline, is formed in the inner peripheral surface of the die instead of the outer peripheral surface of the punch. The die 102 is mounted on the stationary base in the same manner as that in the embodiment shown in FIG. 2. A punch 108 is mounted rotatably on the movable base through thrust bearings, as in the case of the embodiment shown in FIG. 2.

In operation, the movable base is moved to press the punch 108 into the bore of the cylindrical portion 116 through the open end of the latter against the bottom 115. Since the blank 101 is pressed downwardly by the punch 118 which is carried rotatably, the blank 101 is driven into the die 102 while being rotated along the helical angle of the involute spline 109 formed in the inner peripheral surface of the die 102. Meanwhile, a helical involute spline is formed in the portion of the outer cylindrical surface of the cylindrical portion above the stepped outer cylindrical portion 120, by a plastic deformation effected by the involute spline 109 in the inner peripheral surface of the die 102. Consequently, a helical involute spline is formed in the outer cylindrical surface of the cylindrical portion 116 in conformity with the helical involute spline 109 formed in the die 102 by the plastic work. During the plastic work, the material of the cylindrical portion 116 is kept under a complete tensed condition as in the case of the processing of the inner cylindrical surface. It is, therefore, possible to drive the punch with a reduced force, which in turn provides the same advantages as those achieved in the processing of the inner cylindrical surface, i.e. the prevention of seizure and the enhancement of dimensional precision of the processing.

Although the invention has been described through specific forms applied to the formation of helical involute spline in the cylindrical surface of a cylindrical part by a plastic work, it will be clear to those skilled in the art that the invention can equally be applied to the plastic work for forming helical gear teeth, straight spline grooves, spur gear teeth or the like in a cylindrical surface.

It is to be also noted that the "part having grooves or teeth in the cylindrical surface" in this specification involves not only cylindrical parts having supporting portions but also such cylindrical parts as having no substantial supporting portion and the cylindrical parts having a constant diameter of outer peripheral surface.

For processing a cylindrical part having no supporting portion by the processing method of the invention, the supporting portion is beforehand formed on the blank and then removed by a suitable method after the plastic work. Needless to say, it is possible to make use of a supporting portion of the cylindrical part if the part inherently has such a supporting portion.

What is claimed is:

1. A method of mechanically processing a cylindrical surface of a part having a cylindrical portion, the method comprising the steps of: forming a supporting portion on one end of said cylindrical portion and a stepped cylindrical portion in a portion of said cylindrical surface adjacent said supporting portion, said supporting portion being adapted to be arrested by one of a punch and a die and said stepped cylindrical portion being so arranged that the portion of said cylindrical surface adjacent to said supporting portion is free from being processed; forcing said punch into said cylindrical portion to cause a relative axial movement between said punch and said die fitting around said cylindrical portion; and forming grooves or teeth in said cylindrical surface by a plastic deformation while applying a tension caused by said relative axial movement to said cylindrical surface, the other of said punch and die being provided with grooves or teeth to perform said deformation work.

2. A method of mechanically processing a cylindrical surface as claimed in claim 1, wherein said cylindrical surface to be processed is the inner cylindrical surface of said cylindrical portion.

3. A method of mechanically processing a cylindrical surface as claimed in claim 2, wherein said supporting portion is a flange formed on one end of said cylindrical portion.

4. A method of mechanically processing a cylindrical surface as claimed in claim 3, wherein said stepped cylindrical portion has an inside diameter substantially equal to or greater than the outside diameter of said punch and has an axial length substantially equal to or greater than that of said flange.

5. A method of mechanically processing a cylindrical surface as claimed in claim 1, wherein said cylindrical surface to be processed is the outer cylindrical surface of said cylindrical portion.

6. A method of mechanically processing a cylindrical surface as claimed in claim 5, wherein said supporting portion is a bottom formed at one end of said cylindrical portion.

7. A method of mechanically processing a cylindrical surface as claimed in claim 6, wherein said stepped cylindrical portion has an outside diameter substantially equal to or smaller than the minimum inside diameter of said die and an axial length substantially equal to or greater than that of the thickness of said bottom.

* * * * *